US006341155B1

(12) United States Patent
Kuzniar et al.

(10) Patent No.: US 6,341,155 B1
(45) Date of Patent: Jan. 22, 2002

(54) PULSE DETECTION SYSTEM FOR X-RAY TUBES

(75) Inventors: Daniel E. Kuzniar, Lyons; Jason P. Harris, Sr., Aurora, both of IL (US)

(73) Assignee: Marconi Medical Systems, Inc., Highland Heights, OH (US)

( * ) Notice: Subject to any disclaimer, the term of this patent is extended or adjusted under 35 U.S.C. 154(b) by 0 days.

(21) Appl. No.: 09/520,554

(22) Filed: Mar. 8, 2000

(51) Int. Cl.[7] ..... H05G 1/22
(52) U.S. Cl. ..... 378/94; 378/125; 378/119
(58) Field of Search ..... 378/119, 121, 378/125, 127, 128, 134, 135, 136, 161, 94

(56) References Cited

U.S. PATENT DOCUMENTS 4,316,129 A * 2/1982 Shapiro et al. ..... 318/313
4,321,471 A 3/1982 Holland et al.
5,828,210 A 10/1998 Kliman et al.

* cited by examiner

*Primary Examiner*—Robert H. Kim
*Assistant Examiner*—Hoon K. Song
(74) *Attorney, Agent, or Firm*—Fay, Sharpe, Fagan, Minnich & McKee, LLP

(57) ABSTRACT

A rotation monitoring system (70) detects the rotational speed of an anode (10) of an x-ray tube during use. The system (70) includes a detector (72), which detects a pulse of secondary x-rays generated by the interaction of a stream (C) of electrons with a known defect (83) on a surface (84) of the anode. The detector may be position inside or outside a vacuum envelope (14) of the x-ray tube. The stream of electrons is supplied by a secondary source (80), separate from a main source (18) of electrons used to generate the primary or working x-ray beam (B) of the x-ray tube. A single pulse is detected with each rotation of the anode, providing a simple method of calculation of the anode rotation speed. Preferably, a feed back loop is used to correct the rotational speed of the anode so that overheating of the anode is avoided and the useful life of the x-ray tube is extended.

22 Claims, 3 Drawing Sheets

PULSE DETECTION SYSTEM FOR X-RAY TUBES

BACKGROUND OF THE INVENTION

The present invention relates the medical diagnostic arts. It finds particular application in connection with monitoring of the speed of rotation of a rotating anode in an x-ray source, and will be described in conjunction therewith. It should be appreciated, however, that the invention is also applicable to the measurement of the rotation speed of other rotating bodies.

X-ray sources, such as those utilized in the field of medicine for the imaging of subjects, frequently employ a rotating anode, which is bombarded by a beam of electrons from a thermionic filament cathode. A heating current, commonly of the order of 2 to 5 amps, is applied through the filament to create a surrounding electron cloud. A high potential, of about 100 to 200 kilovolts, is applied between the filament cathode and the anode to accelerate the electrons from the cloud towards the anode. The beam of electrons is directed to a focal track on an inclined, annular surface or target area of the anode. X-radiation radiates in response to the impingement of the electrons on the target area.

The acceleration of electrons causes a tube or anode current of about 500–600 milliamps. Only a small fraction of the energy of the electron beam is converted into x-rays, the majority of the energy being converted to heat which heats the anode white hot. The temperature of the anode can be as high as about 1,400° C. In high energy tubes, therefore, the anode rotates at high speeds during x-ray generation to spread the heat energy over a large area and to inhibit the target area from overheating. The cathode and the envelope remain stationary. Due to the rotation of the anode, the electron beam does not dwell on the small impingement spot of the anode long enough to cause thermal deformation. The diameter of the anode is sufficiently large that in one rotation of the anode, each spot on the target area that was heated by the electron beam has substantially cooled before returning to be heated by the electron beam.

The anode is typically rotated by an induction motor. The induction motor includes driving coils, which are placed outside the glass envelope, and a rotor with an armature and a bearing shaft, within the envelope. The armature and/or bearing shaft is connected to the anode. When the motor is energized, the driving coils induce electric currents and magnetic fields in the armature which cause the armature and hence the target area of the anode to rotate.

For maximum useful life of the X-ray source, it is important to maintain the rotational speed of the anode at, or close to, a predetermined value. If the anode rotation speed drops too low, thermal damage to the target area can result. High anode rotation speeds, on the other hand, result in the stator motor operating more than is needed, and can lead to thermal damage. Whenever the motor is running, heat is generated and is transferred to the x-ray tube housing. It is also undesirable for the source to be operated at the rotation speed of mechanical resonance of the anode and the rotor. Additionally, on start-up, it is preferable to delay application of the power to the cathode for generation of electrons until the anode has reached a minimum rotation speed. Accordingly, it is important to be able to measure the speed of rotation of the anode and to be able to make adjustments, if needed, in response to the detected speed.

Various detectors have been developed to ensure that the anode is rotating at its design operation speed. In one design, bearing shaft rotation is detected. For example, an optical feed-through with a fiber optic source is used to detect the movement of an optically readable timing marker fitted to the bearing shaft of the rotor. Devices which measure bearing shaft angle rotation, however, typically involve the installation of an optical, mechanical, or electrically responsive device along the shaft itself, which, in the case of an x-ray source, invades the housing of the source in order to install such a detection device.

In another design, the power to the stator is shut off momentarily, and the back EMF generated by the spinning rotor is measured across the stator. This results in a drop in rotation speed each time the speed is measured.

Devices have been developed which make use of naturally occurring defects in the target area to determine rotation speed. However, these employ complex analytical equipment to compensate for the irregularities of the defects and their uneven spacing on the target.

Lasers have been used as an indirect measurement of the rotational speed. An externally generated laser beam is reflected off the target and used to measure the temperature. The temperature of the target area is dependent on the rotation speed, and thus the measured temperature gives an indirect indication of speed. However, this method does not facilitate correction of the rotation speed. The anode takes a finite time to cool or heat up when the speed is increased or decreased, and thus over-correction may occur.

The present invention provides a new and improved apparatus and method of monitoring the speed of rotation of an anode, which overcomes the above-referenced problems and others.

SUMMARY OF THE INVENTION

In accordance with one aspect of the present invention, a detection system for detecting the rotational speed of an anode of an x-ray tube is provided. The x-ray tube includes a first source of electrons which are accelerated at a target area of an anode to generate a primary x-ray beam. The detection system includes a second source of electrons which are accelerated at the anode to generate a second x-ray beam. A defect on the anode periodically changes an x-ray distribution of the second x-ray beam at least along a detection direction. An x-ray detector detects an intensity of the second x-ray beam along the detection direction.

In accordance with another aspect of the present invention, an x-ray tube is provided. The x-ray tube includes an evacuated envelope and an anode rotatably mounted in the evacuated envelope. The anode has a circular primary target area around a periphery of the anode and an inner circular track of smaller radius than the primary target area. The anode has a construction along the inner track that alters a distribution of generated x-rays. A first cathode cup is mounted within the evacuated envelope for generating electrons that are accelerated into the primary target area to generate a primary x-ray beam. A second cathode cup is mounted within the evacuated envelope for generating electrons that are accelerated at the inner track to generate a secondary x-ray beam. An x-ray distribution of the secondary beam changes each time the accelerated electrons strike the construction. An x-ray detector is positioned to monitor the changes in the secondary beam distribution as the electrons strike the construction. A motor rotates the anode.

In accordance with another aspect of the present invention, a method for determining rotational speed of a rotating anode of an x-ray source is provided. The x-ray source includes a first source of electrons which are directed at a rotatable anode to generate a primary x-ray beam. The method includes providing the anode with a defect in a surface thereof, rotating the anode, and, while the anode is rotating, directing electrons at the anode from a second source of electrons to generate a secondary beam of x-rays. The intensity of the secondary beam of x-rays along a detection direction changes as the defect interacts with the electrons from the second source of electrons. the method further includes determining a rotation speed of the anode from a frequency at which the intensity of the secondary beam of x-rays changes in response to the interaction of the electrons from the second source with the defect.

One advantage of the present invention is that the speed of a rotating x-ray anode is measured.

Another advantage of the present invention is that it enables correction of the rotation speed of the anode in response to the detected rotation speed.

Another advantage of the present invention is that it enables an x-ray tube to be operated at optimum efficiency for a longer useful life.

Another advantage of the present invention is that it enables measurement of anode rotation speed and generation of x-rays to be carried out simultaneously.

Another advantage of the present invention is that it avoids the use of complex analytical equipment for determining anode rotation speed.

Still further advantages of the present invention will become apparent to those of ordinary skill in the art upon reading and understanding the following data ed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
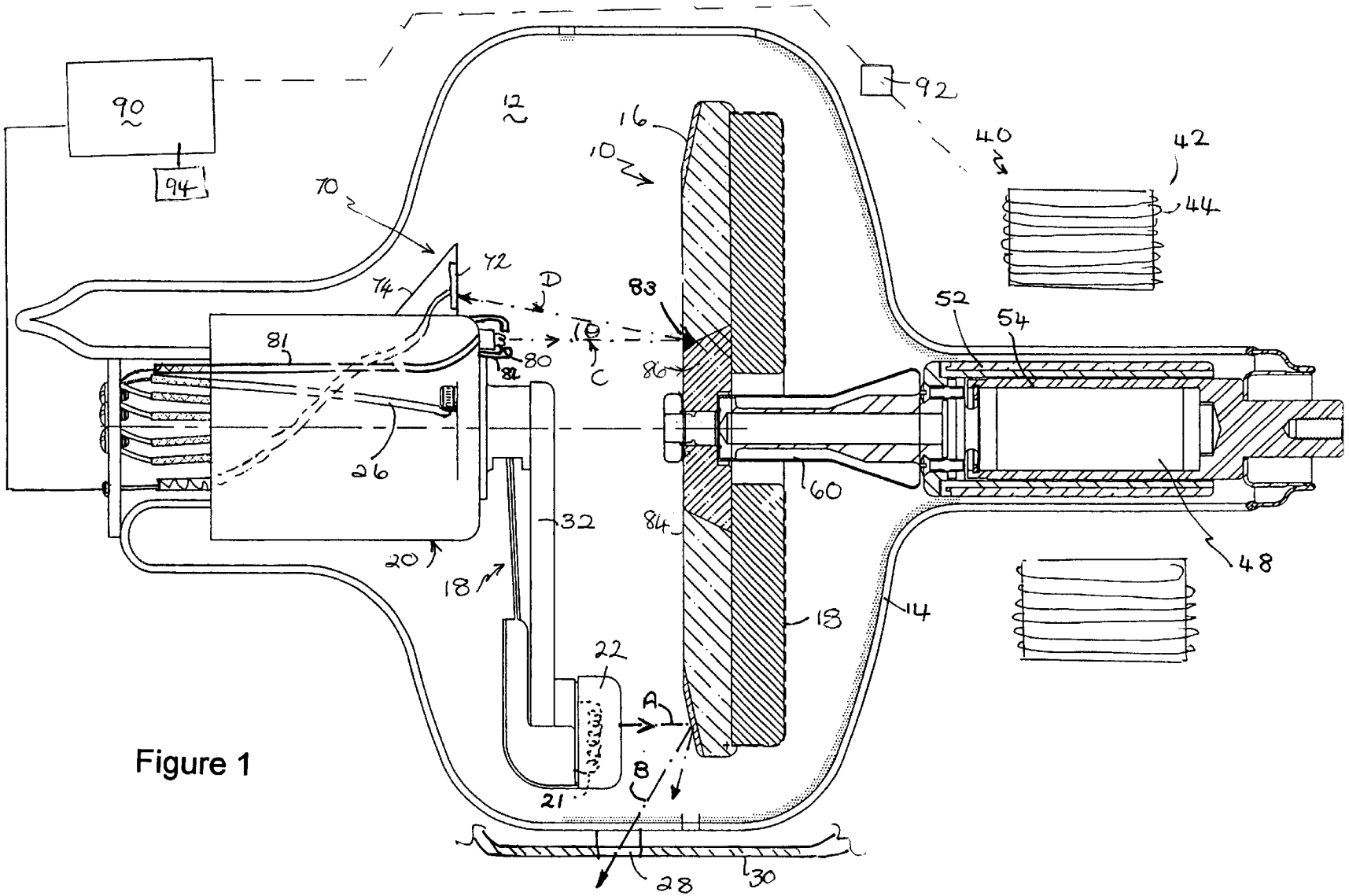
FIG. 1 is a schematic sectional view of a rotating anode tube according to the present invention.

With reference to FIG. 1, a rotating anode x-ray tube of the type used in medical diagnostic systems for providing a beam of x-ray radiation is shown. The tube includes a rotating anode 10 which is disposed in an evacuated chamber 12, defined typically by a glass envelope 14. The anode 10 is disk-shaped and beveled adjacent its annular peripheral edge to define a target area 16. A cathode assembly 18 supplies and focuses an electron beam A which strikes the anode target area 16. The cathode assembly includes an axially extending housing 20, mounted to one end of the glass envelope 14. The cathode assembly 18 also includes a source of electrons 21, such as a thermionic filament mounted in a cathode cup 22, off center in the chamber 12, which directs the beam A of electrons at the target area 16. Filament leads 26 lead in through the glass envelope 14 and into the housing 20 of the cathode assembly to supply an electrical current. When the electron beam A strikes the rotating anode, a portion of the beam is converted to x-rays which are emitted from the anode target area 16 and a beam B of the x-rays passes out of the x-ray tube through the envelope 14 and a window 28 of a surrounding cooling oil enclosure or housing 30. It is this beam B of x-rays which serves the medical and diagnostic functions of the x-ray tube.

The cathode assembly 18 includes an arm 32 which extends radially between the housing 20 and the cathode cup 22 to position the cup adjacent the target area 16.

An induction motor 40 rotates the anode 10. specifically, the induction motor includes a stator 42 having driving coils 44, which are positioned outside the glass envelope 14, and a rotor 48, within the envelope, which is connected to the anode 10. The rotor includes an outer, cylindrical armature or sleeve portion 52 and an inner bearing member or shaft 54, which is centrally aligned within the armature. The armature 52 is connected to the anode by a neck 60 of molybdenum, or other suitable material. When the motor is energized, the driving coils 44 induce magnetic fields in the armature, which cause the armature to rotate relative to the stationary bearing member. Other types of rotors are also contemplated.

A rotation monitoring system 70 detects the rotational speed of the anode 10 as it rotates, preferably in revolutions per minute (rpm). The system 70 includes an x-ray pulse detector 72, which is positioned within the chamber 12. FIG. 1 shows the x-ray pulse detector secured by a bracket 74 to the exterior of the housing 20 of the cathode assembly, although other locations are also contemplated. The detector 72 comprises a scintillation material, such as sodium iodide, for the detection of x-rays that are received by the detector. The x-ray detector 72 is preferably situated on the opposite side of the x-ray tube (i.e. generally 180° C.) from the cathode cup 22, so that the detector is shielded by the cathode assembly and receives little or no x-rays from the portion of the target area 16 adjacent the cathode cup at any given time.

A calibrating filament 80 is built into the housing 20 of the x-ray tube also approximately 180° C. from the cathode cup 22, although other locations in the evacuated chamber are also contemplated. Leads 81 lead in through the glass envelope to the housing 20 to supply an electrical current to the calibrating filament 80. The calibrating filament generates a small cloud of electrons C, which are focused by a surrounding cup 82. The electrons are attracted by the voltage applied between the cathode and the anode into a stream of electrons of much lower energy than the stream A produced by the cathode cup 22, but sufficient to generate a small, low power x-ray beam D when it impinges on the anode 10. The calibrating filament is positioned and focused such that the stream of electrons strike a known defect 83 on the anode, such as a groove, as the defect passes by the calibrating filament. The positioning of the filament 80 is thus preferably such that the center of the calibrating filament is located on the same bolt circle arc as the known defect 83 in the anode.

The known defect 83 can be a hole or pit in the anode surface 84 which faces the cathode assembly 18, or a surface depression, surface prominence, groove, or the like, i.e., anything that will deflect the radiation beam to or from a predetermined direction. Preferably, the defect is positioned away from the target area 16 of the anode. For example, the defect in FIG. 1 is positioned closer to the center of the anode than the target area in a central portion 86 of the anode surface. It is also contemplated that the defect may be positioned on a surface of the anode which faces away from the cathode cup 22, such as on a rear surface of the anode. The filament 80 and detector 72 would also be positioned rearward of the anode, to direct electrons and receive x-rays, accordingly.

During operation of the anode, the calibrating filament 80 is activated and emits a stream of electrons C that impinge on the anode surface 84, creating low energy x-rays, which have a first distribution including a ray D directed generally in a first direction. When the known defect 83 moves directly below the filament electron beam, the distribution changes and the x-ray beam D created by the electron beam is momentarily deflected in another, second direction.

Figure 2:
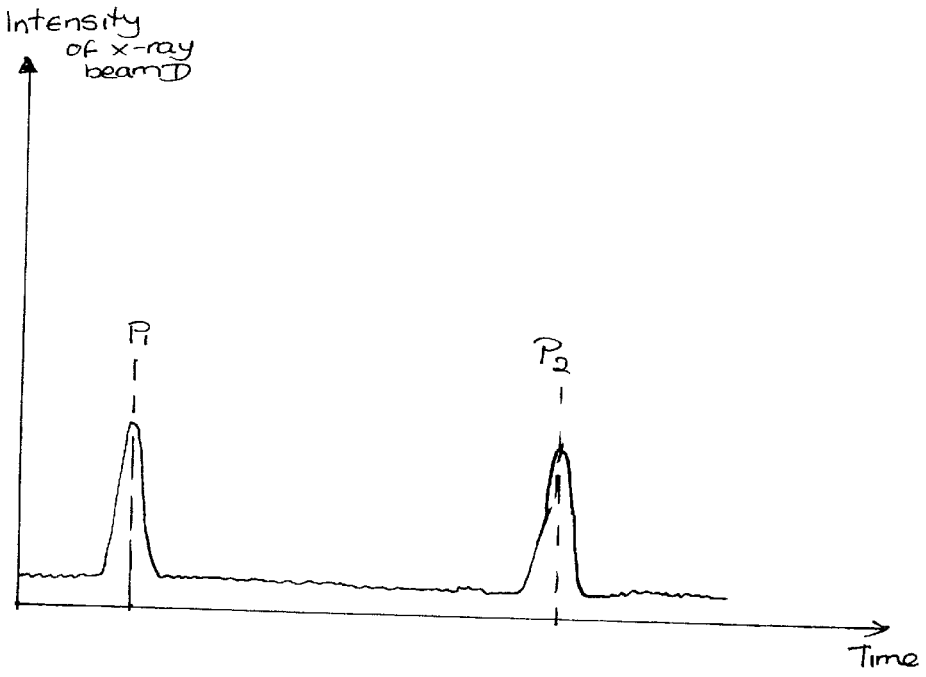
FIG. 2 is a schematic plot of intensity of the x-ray beam received by the detector with time for a defect which directs the x-ray beam toward the detector at times $P_1$ and $P_2$.

In one embodiment, the defect increases the radiation along ray D toward the pulse detector 72, as shown in FIGS. 1 and 2. FIG. 2 shows a schematic plot of x-ray intensity with time for this embodiment. $P_1$ represents a first pulse corresponding to the interaction of the electron beam C with the defect 83. As the known defect moves past the electron stream, the x-ray pulse directed at the pulse detector is redirected back to its original condition (i.e., the first direction). Each time the defect passes the electron stream created by the calibrating filament 80, it sends an x-ray pulse towards the detector 72, thereby indicating the start of another revolution of the anode as indicated by $P_2$. Thus, each revolution of the anode is accompanied by a single pulse $P_n$.

Figure 3:
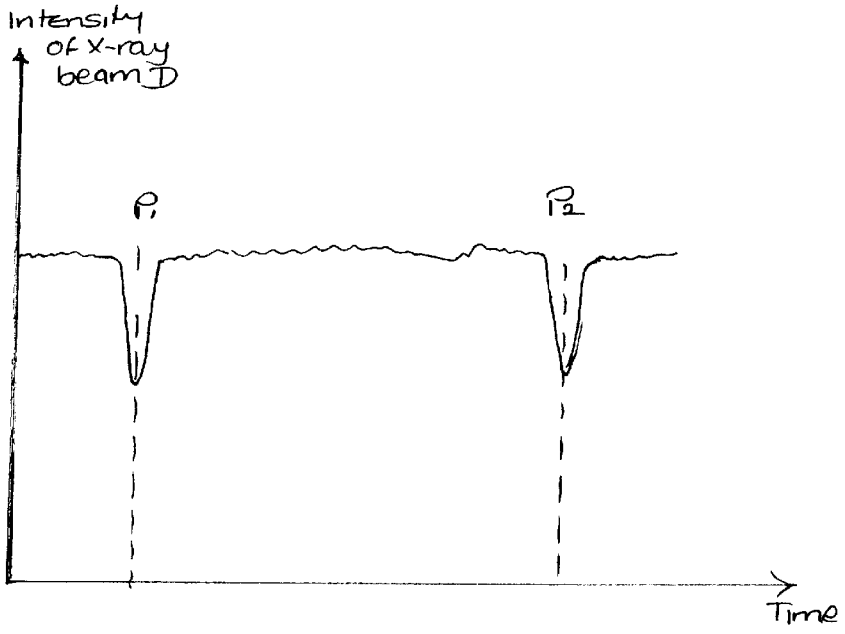
FIG. 3 is a schematic plot of intensity of the x-ray beam received by the detector with time for a defect which directs the x-ray beam away from the detector at times $P_1$ and $P_2$.

In an alternative embodiment, illustrated graphically in FIG. 3, the detector 72 receives the x-ray beam until the defect 83 deflects the beam away from the detector, in a short pulse $P_1$. In either embodiment, the detector 72 registers a change in the strength of the x-ray beam each time the defect passes by the filament 80, i.e., with each revolution of the anode. The time for one rotation is the time between $P_1$, and $P_2$.

Other embodiments are also contemplated, in which the strength of the beam detected by the detector is merely changed as the defect passes by, without complete absence of signal. Similarly, multiple pulses can be generated per revolution by multiple markings on the anode.

The pulse detector 72 signals a measurement system 90, such as a computer control system, which includes electronic circuitry that counts the pulses over time, measures duration between pulses, or measures the frequency of the pulse train and converts the signals to revolutions per minute or other indicator of rotational speed. The speed of the anode is thus monitored without the need to shut off the power to the motor 40, and consequent momentary braking of the anode rotation during the monitoring process.

The defect 83 is preferably intentionally formed, rather than being a naturally occurring defect, and is configured such that the defect deflects the beam of x-rays D with sufficient accuracy and intensity along a preselected angle θ (see FIG. 1) to provide a large x-ray pulse. In this way, the computer control system 90 is able to differentiate a single, large pulse $P_n$ of x-rays with each rotation of the anode 10 (or a single large absence $P_n$ of x-rays in the case of the embodiment of FIG. 3). The single pulse is thus distinct from any other changes in the intensity resulting from naturally occurring defects in the anode surface. This avoids the need for providing complex filtering systems or compensating systems in the control system to filter out or compensate for the minor variations in x-ray intensity resulting from natural defects. The computer control system thus registers a single pulse Pn for each rotation of the anode, rather than a plurality of small pulses, resulting from interactions with naturally occurring defects on the anode surface.

The information about rotation speed is preferably used in a feedback loop, to adjust the rotation speed of the anode, by supplying more or less current to the driving coils 44. Specifically, the control system 90 signals a power supply 92, which delivers the current to the induction motor stator 42. The control system may include a look-up table 94 which indicates what adjustments are necessary in the power supplied to the motor in order to achieve a desired anode rotation speed. For example, the control system may instruct the motor to increase the pulse width of frequency of the current supplied to the motor if the rotation speed is too low, i.e., below a predetermined minimum speed. The control system reduces the power supplied, or even initiates regenerative braking for a short period of time, if the rotation speed is too high, i.e., above a predetermined maximum speed.

Preferably, the control system 90 keeps a record of the measurements made over time. The information may be stored by the control system until accessed by an inspection engineer, and/or printed out periodically for review by the x-ray tube operator. The information can be used to determine x-ray tube performance over time (tube loading and optimization). Scanner electronics can also monitor RV/RW conditions of the rotating anode. The information enables a determination of when the change-out time for the x-ray tube is near and provides an inspection engineer with a record of real time anode performance over the life of the tube. The information also may be used to determine previously undetected customer misuse.

Detection of the rotation speed of the anode can be carried out while the first source 18 of x-rays is on or off, and may be carried out continuously or intermittently.

Figure 4:
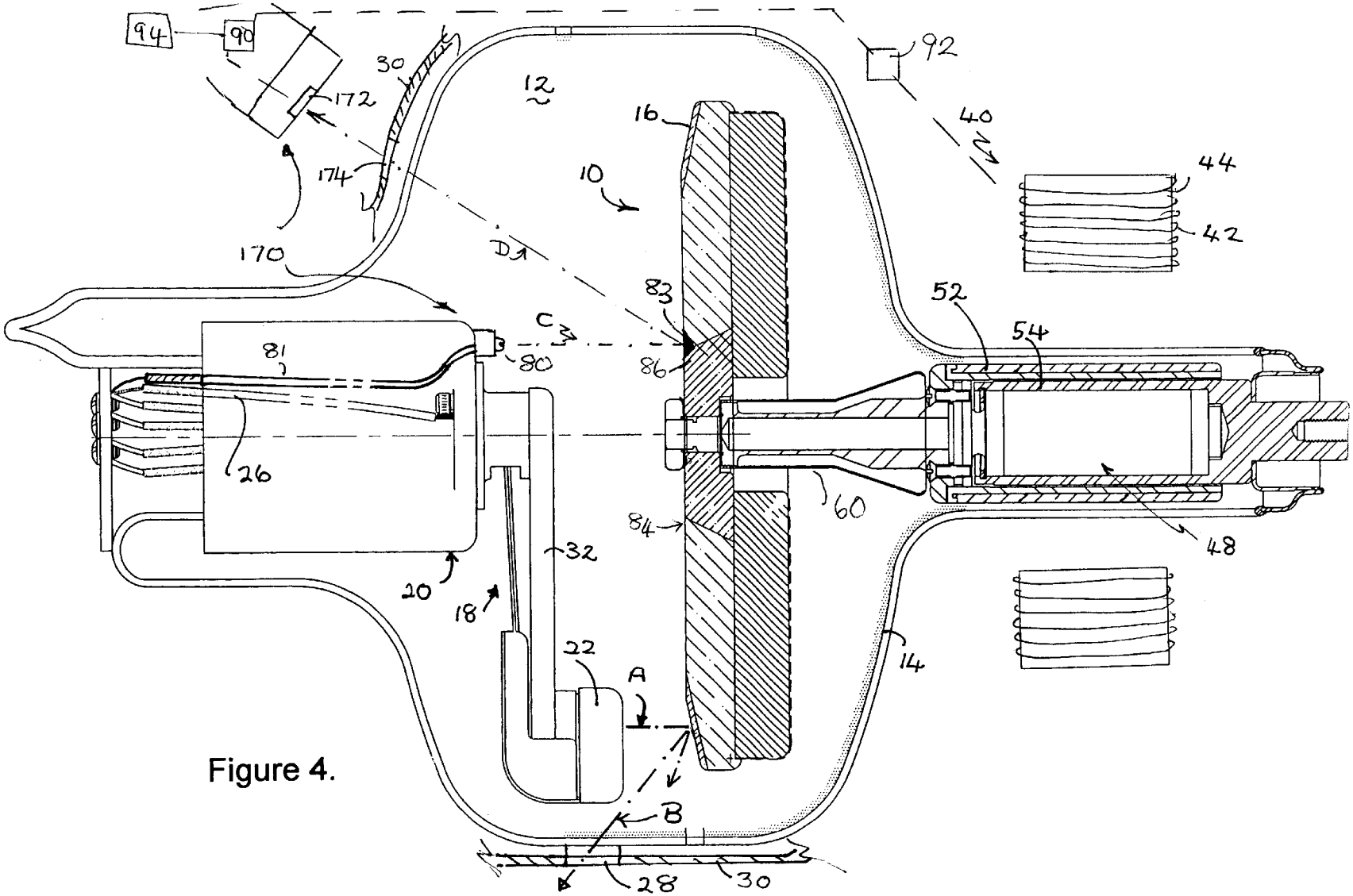
FIG. 4 is a schematic sectional view of a rotating anode tube according to a second embodiment of the present invention.

With reference to FIG. 4, in an alternative embodiment, an x-ray tube is similar in most respects to the x-ray tube of FIG. 1. Like parts are numbered with the same numerals. A detection system 170 is similar to the detection system 70 of FIG. 1, except in that the pulse detector 172 is positioned outside the x-ray tube. The detected x-rays D pass directly through the envelope 14 and an appropriately positioned window 174 in the cooling oil enclosure 30 to the detector 172.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A detection system for detecting the rotational speed of an anode of an x-ray tube, the x-ray tube including a first source of electrons which are accelerated at a target area of an anode to generate a primary x-ray beam, the detection system comprising:

a second source of electrons which are accelerated at the anode to generate a second x-ray beam;

a defect on the anode which periodically changes an x-ray distribution of the second x-ray beam at least along a detection direction; and an x-ray detector which detects an intensity of the second x-ray beam along the detection direction.

2. The detection system of claim 1, wherein the detection system further includes:

a measuring system, which determines a rotational speed of the anode from a frequency at which the second x-ray beam changes intensity along the detection direction.

3. The detection system of claim 1, wherein the detection system registers a pulse of x-rays each time the electrons impinge upon the defect.

4. The detection system of claim 1, wherein the detector is positioned within an evacuated chamber of the x-ray tube.

5. The detection system of claim 1, wherein the detector is positioned outside an evacuated chamber of the x-ray tube.

6. The detection system of claim 1, wherein the defect is selected from the group consisting of a hole in the anode surface, a surface depression, a surface prominence, and a groove.

7. The detection system of claim 1, wherein the defect is spaced from the target area.

8. The detection system of claim 1, wherein the first and second sources are radially spaced.

9. The detection system of claim 8, wherein the first and second sources are circumferentially spaced about 180 degrees apart.

10. The detection system of claim 1, wherein the second source of radiation includes a filament which generates the electrons.

11. The detection system of claim 10, wherein the second x-ray beam is of lesser intensity than the primary x-ray beam.

12. The detection system of claim 1, wherein the target area extends around a circular circumference of the anode and the defect is displaced radially from the target area.

13. An x-ray tube comprising:

an evacuated envelope;

an anode rotatably mounted in the evacuated envelope, the anode having a circular primary target area around a periphery of the anode and an inner circular track of smaller radius than the primary target area, the anode having a construction along the inner track that alters a distribution of generated x-rays;

a first cathode cup mounted within the evacuated envelope for generating electrons that are accelerated into the primary target area to generate a primary x-ray beam;

a second cathode cup mounted within the evacuated envelope for generating electrons that are accelerated at the inner track to generate a secondary x-ray beam, an x-ray distribution of the secondary beam changing each time the accelerated electrons strike the construction;

an x-ray detector positioned to monitor the changes in the secondary beam distribution as the electrons strike the construction; and a motor for rotating the anode.

14. The x-ray tube of claim 13, further including:

a controller which receives the output of the x-ray detector and controls the motor in accordance with the monitored changes in the secondary beam distribution.

15. A method for determining rotational speed of a rotating anode of an x-ray source, the x-ray source including a first source of electrons which are directed at a rotatable anode to generate a primary x-ray beam, the method comprising:

(a) providing the anode with a defect in a surface thereof;

(b) rotating the anode;

(c) while the anode is rotating, directing electrons at the anode from a second source of electrons to generate a secondary beam of x-rays, the intensity of the secondary beam of x-rays along a detection direction changing as the defect interacts with the electrons from the second source of electrons;

(d) determining a rotation speed of the anode from a frequency at which the intensity of the secondary beam of x-rays changes in response to the interaction of the electrons from the second source with the defect.

16. The method of claim 15, wherein the step of determining the rotation speed includes determining the time between a first pulse of x-rays as the defect interacts with the electrons from the second source of electrons and a subsequent pulse.

17. The method of claim 15, wherein a detector registers a pulse of x-rays each time the electrons from the second source interact with the defect.

18. The method of claim 15, wherein a detector registers an interruption of received x-rays as the electrons from the second source interact with the defect.

19. The method of claim 15, wherein the secondary beam of x-rays is detected within an evacuated chamber of the x-ray source.

20. The method of claim 15, wherein the secondary beam is detected outside an evacuated chamber of the x-ray source.

21. The method of claim 15, wherein the determined rotation speed is used to control rotation of the anode.

22. The method of claim 15, further including blocking generation of the primary x-ray beam until the detected anode rotation speed exceeds a preselected minimum.

* * * * *